United States Patent [19]

Bolin

[11] 4,053,338

[45] Oct. 11, 1977

[54] METHOD OF FABRICATING COMPRESSED GAS INSULATED CABLE

[75] Inventor: Philip C. Bolin, Northboro, Mass.

[73] Assignee: Westinghouse Electric Corporation, Pittsburgh, Pa.

[21] Appl. No.: 693,241

[22] Filed: June 4, 1976

[51] Int. Cl.[2] ..... H01B 13/00

[52] U.S. Cl. ..... 156/48; 174/14 R; 174/16 B; 174/27

[58] Field of Search ..... 156/48; 174/27, 28, 174/17 GF, 99 R, 99 B, 14 R, 16 B; 138/113, 114, 157

[56] References Cited

U.S. PATENT DOCUMENTS

| | | | |
|---|---|---|---|
| 2,112,740 | 3/1938 | Humphrey | 174/17 GF |
| 2,141,894 | 12/1938 | Alexanderson | 174/17 GF X |
| 3,864,507 | 2/1975 | Fox et al. | 174/28 X |

*Primary Examiner*—David A. Simmons
*Attorney, Agent, or Firm*—M. S. Yatsko

[57] ABSTRACT

A method of fabricating a compressed gas insulated cable which includes the steps of securing an electrical conductor to an insulating spacer; securing the spacer to a sheath section which forms a portion of circumference of the outer sheath of the gas insulated cable; and then sealingly securing the sheath sector together to form the outer shell.

11 Claims, 4 Drawing Figures

METHOD OF FABRICATING COMPRESSED GAS INSULATED CABLE

BACKGROUND OF THE INVENTION

This invention relates generally to electrical conductors, and more particularly to a method of fabricating a compressed gas insulated cable.

Compressed gas insulated transmission lines are being used in an ever increasing scale in recent years due to the desirability of increasing safety, problems in acquiring right-of-way for overhead lines, and higher power loads required by growing metropolitan areas and growing demands for electrical energy. Compressed gas insulated transmission lines typically comprise a hollow sheath, a conductor in the sheath, a plurality of solid insulating spacers which support the conductor, and a compressed gas such as sulfur hexaflouride or the like in the sheath to insulate the conductor from the sheath. The typical assembly has been fabricated from relatively short sections of hollow cylindrical ducts or tubes in which the conductor and insulators are inserted. This assembly is usually completed in the factory, and the sections are welded or otherwise secured together in the field to form the transmission line. Gas barriers are provided at intervals along the length of the assembly, and, after evacuation of the line, an insulating gas is forced into the sheath under pressure. It is also known to provide a particle trap in compressed gas insulating transmission lines as is disclosed in the patent to Trump, U.S. Pat. No. 3,515,939. The particle trap of Trump is used to precipitate out of the insulting gas, particles of foreign matter which could adversely affect the breakdown voltage of the dielectric gas.

Problems have arisen, however, in the use of such compressed gas insulated cables. Two or more parts, the sheath and conductor, must be thoroughly cleaned separately and then assembled into the final units without introducing even the slightest amount of contamination. The clearance necessary to get the several parts together necessitates the use of folded or wedged type joints between the several parts, or purposely leaving the parts loose on plastic pads. These methods require several sequential operations over a period of time during which contamination can be produced or enter and the use of expensive tubing with special mounting provisions or complicated mounting rings which fit inside the sheath tubing.

One sheath which has been designed to overcome these problems is illustrated in the U.S. Patent to Fox et al, U.S. Pat. No. 3,864,507. In the Fox et al patent, the outer sheath is constructed from sheath sectors which mate together to form the outer cylindrical sheath. However, this sheath is not entirely satisfactory, as the assembly in the field of the gas insulated cable is not very efficient, and alignment and assembly problems may occur.

SUMMARY OF THE INVENTION

The aforementioned problems of the prior art are eliminated by this invention by providing for a method of fabricating a compressed gas insulated cable, which cable includes an electrical conductor with a spacer supporting the conductor within a substantially cylindrical outer sheath. The cable also includes an insulating gas electrically insulating the conductor from the sheath, and the sheath is formed of a plurality of sheath sectors each of which forms a portion of the circumference of the sheath. The fabrication method comprises attaching the conductor to the spacer, securing the spacer to one of the sheath sectors, and sealingly securing the sheath sectors together to form the outer sheath.

BRIEF DESCRIPTION OF THE DRAWINGS

Reference is now made to the description of the preferred embodiment, illustrated in the accompanying drawings, in which.

DESCRIPTION OF THE PREFERRED EMBODIMENT

Figure 1:
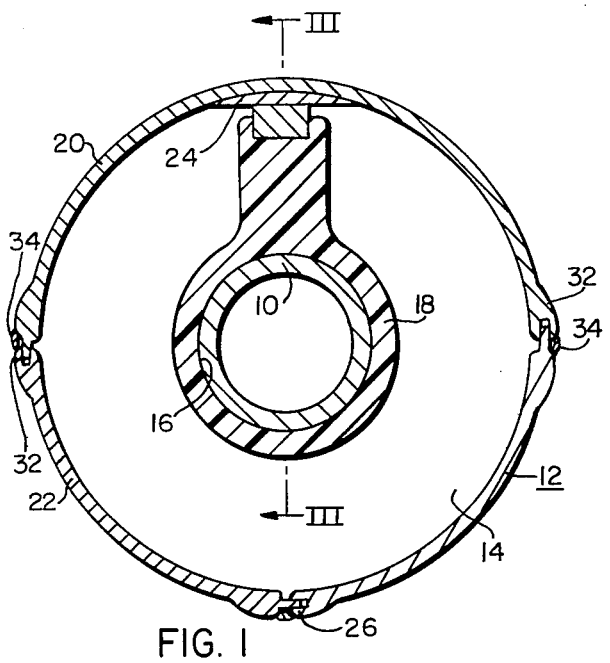
FIG. 1 is a cross-sectional view through a compressed gas insulated, single phase cable.

Referring now more particularly to FIG. 1, there is illustrated a single-conductor compressed gas insulated cable fabricated according to the method of this invention. An electrical conductor 10 is disposed within the outer sheath 12, and an insulating gas 14, such as sulfur hexaflouride, is disposed within the sheath 12. The insulating gas 14 electrically insulates the conductor 10 from the outer sheath 12. The electrical conductor 10 is disposed within an opening 16 formed within a post spacer 18. The post spacer 18 functions to support the electrical conductor 10 within the cylindrical outer sheath 12.

The outer sheath 12 is comprised of two sheath sectors 20 and 22. Each sheath sector 20, 22 forms a portion of the circumference of sheath 12. To one sheath sector 20 is secured, by welding, a mounting plate 24. The other sheath section 22 has formed therein, such as during the extrusion of the sheath sectors 20, 22, a longitudinal slot 26 whose function is the trapping of any contaminating particle (not shown) which may be present within the insulating gas 14 and which may cause an electrical breakdown. The post spacer 18 is secured to the mounting plate 24 by means such as bolts (not shown).

Figure 3:
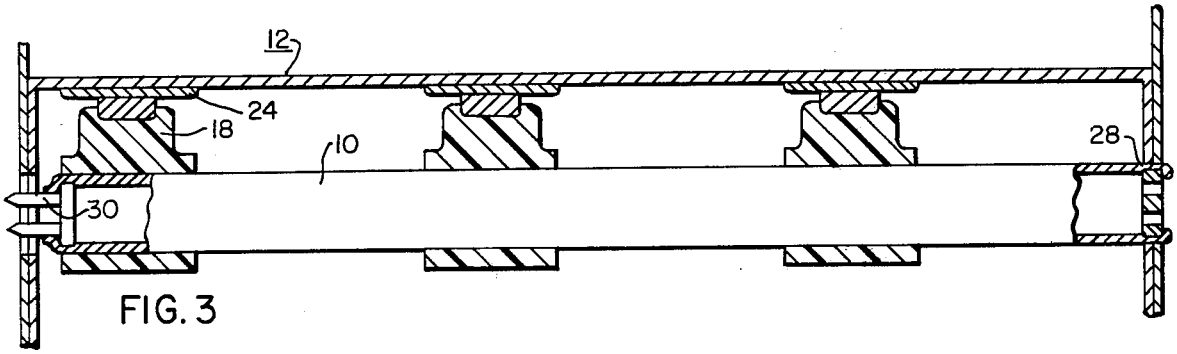
FIG. 3 is a longitudinal view taken along lines III—III of either FIGS. 1 or 2.

Referring now to FIG. 3, therein is shown a longitudinal view of the cable illustrated in FIG. 1. As can be seen, a plurality of post spacers 24 supports the elongated electrical conductor 10. One end of the electrical conductor has a joint socket 28, and the opposite end of the conductor has a joint plug 30. The joint socket 28 and plug 30 function to enable two like-sections of electrical conductor to be connected together to form a compressed gas insulated transmission line or cable. As shown, all the post spacers 18 are secured to the outer sheath 12 by the mounting plates 24. The joint plug 30 from one conductor 10 is inserted into the joint socket 28 of adjoining sections, thereby making electrical contact and maintaining electrical continuity between conductors 10.

The compressed gas insulated cable illustrated in FIG. 1 was fabricated according to the method of this invention. The electrical conductor 10 was inserted within the opening 16 within the post spacer 18. The post spacer 18, in turn, was secured to the outer sheath 12. More specifically, the post spacer 18 is secured to the mounting plate 24, which mounting plate has been welded to the sheath sector 20. Although the method has been described as inserting the conductor 10 into the post spacer 18 prior to securing the spacer 18 to the sheath sector 20, it is to be understood that the order of these two steps may be reversed and the post spacer 18 may be secured to the sheath sector 20 prior to insertion of the electrical conductor 10 into the opening 16. After the conductor 10 has been inserted into the opening 16 of the post spacer 18, and the post spacer 18 has been secured to the sheath sector 20, the two sheath sectors 20, 22 are sealingly secured to each other to form the outer sheath 12. The two sheath sectors 20, 22 are secured together at their joint 32 preferably by means of the weld 34.

The fabrication of the compressed gas insulated cable in this manner provides numerous advantages: the integrity and cleanliness of the sheath sectors and conductor assembly can be ascertained just prior to the final assembly; the conductor assembly is simply and securely mounted to the sheath 12 eliminating most tolerance and assembly problems and reducing vibration during shipping; the sector extrusions are less expensive than extruded, seam or spiral welded tubing; and the cost of the support spacer is reduced since it is only a single post with a simple mounting plate.

Figure 2:
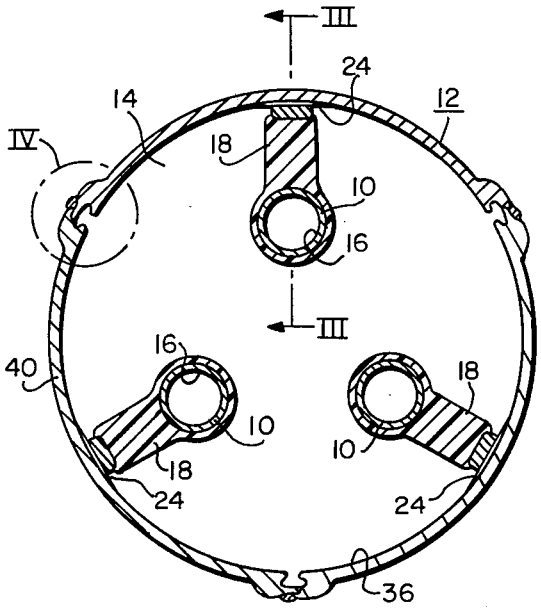
FIG. 2 is a cross-sectional view through a compressed gas insulated, multiphase cable.

Referring now to FIG. 2, therein is illustrated a multiconductor compressed gas insulated transmission line. The transmission line, as before, comprises an outer sheath 12 housing a plurality, in this case three, of electrical conductors 10. The conductors 10 are supported within the outer sheath 12 by the post spacers 18. The conductors 10, similar to that of FIG. 1, are inserted within openings 16 formed within the post spacers 18. The post spacers 18 are secured to mounting plates 24, which mounting plates 24 are in turn secured to the sheath sectors 36, 38, and 40. The sheath sectors 36, 38 and 40 like the sheath sectors 20, 22 of FIG. 1, each form a portion of the circumference of the substantially cylindrical outer sheath 12. The sheath sectors 36, 38 and 40 illustrated each has the same circumferential length, or distance along an arc, as each other sheath sector. The number of sheath setors 36, 38 and 40, is equal to the number of conductors 10, and the spacers 18 are positioned in a central location along the circumferential length of each spacer. By so positioning the spacers, the three phases of the electrical transmission system are each spaced equi-distantly apart.

Figure 4:
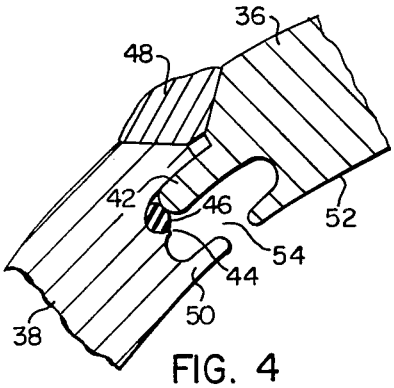
FIG. 4 is a detailed view of a joint between two adjacent sheath sections of the cable illustrated in FIG. 3.

The method of fabricating the transmission line of FIG. 2 is similar to that described in connection with the single conductor line of FIG. 1. The conductors 10 are inserted into the openings 16 formed within the post spacer 18 associated with each conductor 10. The post spacers 18 are, in turn, secured to the sheath sector 36, 38 and 40 associated with that post spacer 18. After the conductors 10 have been inserted into the openings 16 and the spacers 18 secured to the sheath sectors 36, 38, and 40 the sheath sectors 36, 38 and 40 are sealingly secured together to form the cylindrical outer sheath 12. FIG. 4 illustrates one method of joining the sheath sectors 36, 38, and 40 together which also functions as a particle trap.

One sheath sector, for example 36, has a tongue 42 at one end thereof, and the adjoining sheath sector 38 has a groove 44 therein adjacent the tongue 42 of the adjacent sheath sector 36. The tongue 42 fits within the groove 44 of the adjoining sheath sector, with a seal 46 also being present within the groove 44. The two sheath sectors 36, 38 are joined together by the weld 48. The seal 46 and the tongue and groove arrangement prevents any weld splatter from the weld 48 from entering within the outer sheath 12. Alternately, a simple overlap joint with seal (not shown) may be used.

The interior side 50, 52 of sheath sectors 36, 38 respectively are formed at their terminations so as to form a longitudinal slot 54 therebetween. This longitudinal slot 54 can then function as a continuous particle trap to minimize the effect of loose conducting particles on the insulating gas 14. If so desired instead of utilizing the joint between the sheath sectors as a particle trap other types of particle traps may be affixed to the interior of the sheath sectors prior to their jointure.

Therefore, it can be seen that this invention provides a method for fabricating a compressed gas insulated cable which minimizes the cost of the fabrication and additionally provides more efficient contamination control than was previously obtainable.

I claim as my invention:

1. A method of fabricating a compressed gas insulated cable including a cylindrical electrical conductor disposed within a cylindrical opening formed in a post spacer, said spacer supporting said conductor within a substantially cylindrical outer sheath, and an insulating gas electrically insulating said conductor from said sheath, said sheath being formed of a plurality of sheath sectors each of which forms a portion of the circumference of said sheath, said method comprising:

inserting said conductor within said post spacer opening;

securing said spacer to one of said sheath sectors; and sealingly securing said sheath sectors together to form said outer sheath.

2. The method according to claim 1 wherein said sheath sectors are extended.

3. The method according to claim 1 including installing particle trapping means adjacent one of said sheath sectors for the trapping of particles.

4. The method according to claim 1 including welding a mounting plate to one of said sheath sectors; and securing said spacer to said mounting plate.

5. The method according to claim 1 wherein the step of inserting said conductor within said post spacer opening occurs prior to the step of securing said spacer to one of said sheath sections.

6. The method according to claim 1 including forming a longitudinal slot within one of said sheath sectors for the trapping of particles.

7. A method of fabricating a multiconductor compressed gas insulated transmission line wherein a plurality of cylindrical electrical conductors are supported within a generally outer cylindrical sheath by a plurality of post spacers with an insulating gas electrically insulating said conductors from said sheath and from each other, said sheath being formed from a plurality of sheath sectors each of which forms a portion of the circumference of said sheath, each of said conductors having a spacer and a sheath sector associated therewith, said conductors being disposed within cylindrical openings formed within said post spacers, said method comprising:

inserting each of said conductors within the opening formed in said post spacer associated therewith;

securing each of said spacers to said sheath sector associated therewith; and sealingly securing said sheath sectors together to form said outer sheath.

8. The method according to calim 7 including welding a mounting plate to each of said sheath sectors having a post spacer associated therewith; and securing said spacers to said mounting plates.

9. The method according to claim 7 wherein the number of sheath sectors is equal to the number of electrical conductors.

10. The method according to claim 9 wherein each sheath sector has the same circumferential length as each other sheath sector; and each spacer is centrally positioned along said sheath sector associated therewith, wherein said conductors are spaced equi-distantly apart.

11. The method according to claim 7 including joining said sheath sectors together such that a longitudinal slot is formed therebetween on the interior side thereof.

* * * * *